US010576506B2

(12) United States Patent
Bunge

(10) Patent No.: US 10,576,506 B2
(45) Date of Patent: Mar. 3, 2020

(54) METHOD AND DEVICE FOR BULK SORTING MACHINES

(71) Applicant: HOCHSCHULE RAPPERSWIL, Rapperswil (CH)

(72) Inventor: Rainer Bunge, Alpthal (CH)

(73) Assignee: HSR HOCHSCHULE FÜR TECHNIK RAPPERSWIL, Rapperswil (CH)

( * ) Notice: Subject to any disclaimer, the term of this patent is extended or adjusted under 35 U.S.C. 154(b) by 145 days.

(21) Appl. No.: 15/535,598

(22) PCT Filed: Dec. 15, 2015

(86) PCT No.: PCT/EP2015/079721
§ 371 (c)(1),
(2) Date: Jun. 13, 2017

(87) PCT Pub. No.: WO2016/096802
PCT Pub. Date: Jun. 23, 2016

(65) Prior Publication Data

US 2017/0326597 A1 Nov. 16, 2017

(30) Foreign Application Priority Data

Dec. 15, 2014 (CH) ..... 1932/14

(51) Int. Cl.
*B07C 5/344* (2006.01)
*B07C 5/34* (2006.01)
*B03C 1/23* (2006.01)

(52) U.S. Cl.
CPC ..... *B07C 5/344* (2013.01); *B03C 1/23* (2013.01); *B07C 5/34* (2013.01); *B03C 2201/20* (2013.01); *B07C 2501/0018* (2013.01)

(58) Field of Classification Search
CPC ... B07C 5/34; B07C 5/344; B07C 2501/0018; B03C 1/23; B03C 2201/20
See application file for complete search history.

(56) References Cited

U.S. PATENT DOCUMENTS 4,718,559 A * 1/1988 Kenny ..... B03B 9/061 209/571
6,060,677 A * 5/2000 Ulrichsen ..... B07C 5/342 209/577
2013/0233776 A1* 9/2013 Berkhout ..... B07B 13/10 209/644
2015/0108047 A1* 4/2015 Rem ..... B03C 1/247 209/555
2017/0014868 A1* 1/2017 Garcia, Jr. ..... B07C 5/3416

FOREIGN PATENT DOCUMENTS

WO 2012118373 A1 9/2012

* cited by examiner

*Primary Examiner* — Charles A Fox
*Assistant Examiner* — Kalyanavenkateshware Kumar
(74) *Attorney, Agent, or Firm* — Browdy and Neimark, PLLC

(57) ABSTRACT

Bulk sorting using a bulk sorting machine that comprises a conveying means (7), an exciter (5) for generating a separating force, a splitter (1) with a blade, and a sensor (2) that senses the particles hitting the blade. The signal generated by the sensor (2) is used to optimize the result of the separation process.

27 Claims, 7 Drawing Sheets

METHOD AND DEVICE FOR BULK SORTING MACHINES

TECHNICAL FIELD

The invention falls within the field of reprocessing technology and relates to a method for sorting a stream of bulk material, to a sorting device and also to a bulk-material sorting plant.

PRIOR ART

Bulk-material sorters—as represented in FIGS. 6, 7, 8 in respect of an eddy-current separator, a magnetic separator and an electrostatic separator—serve for separating a bulk material into at least two products: a concentrate 20 and a residue 21. In order to separate the products from one another, or to sort them, bulk-material sorters are frequently equipped with a splitter 1. The upper ridge of the splitter is designated as the separating edge.

The following configurations will be illustrated on the basis of an eddy-current separator according to FIG. 6; with due alteration of details, they can be carried over to other bulk-material sorters that are provided with a separating edge. Eddy-current separators according to FIG. 6 serve for separating electrically conductive material 10 and electrically non-conductive material 11. They consist of a conveying means 7 and an exciter 5 for a separating force. Whereas the non-conductive particles 11 follow the trajectory for horizontal projection after being jettisoned from the belt and are discharged as residue 21, the conductive particles 10 pass into the concentrate 20 as a result of deflection by means of the separating force generated by 5. The allocation of the particles to one of the products (residue, concentrate) is undertaken by a splitter 1 which, as a rule, is adjustable and which has an upper ridge which will be designated in the following as a separating edge. Besides depending on conductivity, the trajectories of the particles also depend on a large number of further factors, in particular on the grain size, the grain shape, the alignment of the particles on the conveying means, the speed of the conveying means and also the throughput. As a rule, therefore, an over-lapping occurs of the trajectories of conductive and non-conductive particles. For example, the trajectories of small conductive particles 10*b* may intersect with those of larger non-conductive particles 11*a* (FIG. 3).

The separation outcome of eddy-current separators is crucially defined by the position of the separating edge. In practice, the separating edge is set manually by the plant personnel by eye and is only rarely checked during operation. In this connection it is unsatisfactory, firstly, that the setting is undertaken subjectively, and, secondly, that it is not corrected automatically when conditions change. Typical parameters that can influence the trajectories of the particles in a manner unnoticed by the plant personnel and therefore impair the separation outcome, are:

- change in the grain size (in which case larger particles fly further than small ones)
- change in the dampness of the material (in which case the particles are left "sticking" more or less strongly to the conveying means)
- change in the conveying speed, for example as a consequence of an overheating drive motor for the conveying means
- change in the separating force (for example, by increased occurrence of paramagnetic particles which disturb the magnetic field of the eddy-current separator)

- "baked-on deposits" on the conveying means increase the spacing of the particles from the magnetic field and consequently reduce the repulsion.

If, for example, the separating edge is set for coarse-grained material, then after a change in the composition of the material—for example, by a shift of the grain size downward—all particles, whether conductive or not, pass into the residue; so no separation takes place. Only by resetting of the separating edge can a good separation success be re-established.

An approach for improving the sorting has become known from WO 2012/118373. According to the method presented in WO 2012/118373, the number of particles and, where appropriate, also the particle composition—in particular, the metal content—in at least one of the two products is/are measured. The results of measurement are utilized for the purpose of regulating the position of the separating edge. In this connection it is disadvantageous that, in practice, it is very costly to measure the total number of particles in a product as well as the relevant properties thereof. In WO 2012/118373 the detection of only a partial stream is also proposed, though this raises the question of the degree to which individual partial streams are representative of the total stream.

SUMMARY OF THE INVENTION

The object underlying the invention is to create a method and a device that permit the separation outcomes of bulk-material sorters with separating edges to be improved. In particular, it is an object to obtain the improvement without a complex measuring technique being required for this purpose.

Accordingly, a method serves for sorting a stream of bulk material having at least a first bulk-material fraction in which material has been enriched that reacts weakly to the separating force, and having a second bulk-material fraction in which material has been enriched that reacts strongly to the separating force. Weakly electrically conductive particles, for example, have been enriched in the first bulk-material fraction, and particles that are more strongly electrically conductive have been enriched in the second bulk-material fraction. The stream of bulk material is directed toward a splitter, to be positioned between the bulk-material fractions, having a separating edge preferentially directed contrary to the stream of bulk material. Furthermore, at least one sensor for detecting the particles has been provided. The bulk-material fractions only partially overlap on or slightly above the separating edge, or do not overlap at all. The at least one sensor detects the number stream of the particles that pass through the detection region of the at least one sensor. Furthermore, a control signal based on the detected number stream and on the corresponding position of the at least one sensor is made available. The separating edge and the stream of bulk material are aligned relative to one another on the basis of the control signal in such a manner that the first bulk-material fraction comes to be situated substantially on the one side of the separating edge and the second bulk-material fraction comes to be situated substantially on the other side of the separating edge.

The detection of the location-dependent number stream of the particles in the region of the separating edge can be undertaken with a simple sensor arrangement, this having the advantage that a elaborate measuring technique is dispensed with. The number stream is detected spatially, preferentially resolved in the horizontal plane. By virtue of the detection region covered by means of the at least one sensor, a selective detection of the particles can occur in a selected region of the overall particle stream. With regard to number stream or composition, this region is, as a rule, not representative of one of the two bulk-material fractions or of one of the products generated. The region serves merely for the detection and spatial assignment of a number stream that is relevant for the positioning of the splitter.

By the mode of expression "separating edge directed contrary to the stream of bulk material", the orientation of the longitudinal axis of the splitter passing through the separating edge and aligned parallel to the stream of bulk material is preferably understood. When the stream of bulk material falls down onto the separating edge substantially perpendicularly, the longitudinal axis of the splitter, directed contrary to the stream of bulk material, has been aligned substantially vertically.

By an "only partial overlapping of the two bulk-material fractions", it is understood that the bulk-material fractions overlap only at the edge of their spatial extent. In the region of overlapping, both the first and the second bulk-material fractions are present. The first bulk-material fraction is then present practically exclusively laterally in relation to the region of overlapping, and the second bulk-material fraction is then present practically exclusively on the other side.

By the mode of expression "number stream", particles detected per unit of time are understood. Accordingly, the number stream is defined as particles detected per unit of time. When in this connection it is a question of the detection or measurement of a number stream, this also includes measurements from which the local number stream can be determined—for example, the measurement of the mass flow or the measurement of the trajectory density.

By "alignment" or "positioning" of the separating edge, the change in the position of the separating edge in space is understood. Advantageously, a displacement of the separating edge is obtained by the horizontal displacement of the splitter. By "alignment" or "positioning" of the separating edge, however, the vertical displacement of the separating edge by vertical displacement of the splitter or extension thereof, as well as other spatial changes of position of the separating edge, for example by tilting of the splitter about a horizontal axis of rotation, are also possible. A combined motion in the horizontal plane and in the vertical plane is also conceivable.

By the mode of expression "detection region", a selective region is understood that occupies a part of the entire space that is defined by an envelope surrounding the stream of bulk material. The detection region may be three-dimensional or two-dimensional. The at least one sensor can be freely positioned within the detection region. In other words, the extent of the detection region can be defined substantially by the positionability of the at least one sensor.

The detection region may be independent of the region in which the splitter with the separating edge can be positioned. In this case, the separating edge can be positioned independently of the extent of the detection region. The positioning of the separating edge can be undertaken inside or outside the detection region.

The detection region may alternatively be dependent on the region in which the splitter with the separating edge can be positioned. This may be the case, for example, when the at least one sensor has been fixedly connected to the splitter and, in particular, has been fitted immediately adjacent to the separating edge.

The detection region is preferentially situated above or at the level of the separating edge. This means that prior to impinging on the separating edge the particles pass through the detection region and are detected there by the sensor. Accordingly, the at least one sensor has preferentially been arranged above the separating edge, specifically in such a manner that the particles are detected by the at least one sensor before impinging on the separating edge.

The detection region of the at least one sensor has preferentially been oriented parallel to the separating edge. Depending upon the sensor arrangement, the detection region may spread out transversely and/or with respect to its height in relation to the separating edge.

The detection region is preferentially a selective region situated in the region of the separating edge. The detection of the particles exclusively in the detection region has the advantage that the arrangement of the sensors and also the evaluation of the sensor data can be greatly simplified.

In a variant, the detection region is defined by a plane that extends substantially parallel to the separating edge and transversely in relation to the longitudinal axis of the splitter and, in particular, on or above the separating edge. In other words, this plane is situated perpendicular to the separating edge aligned contrary to the stream of bulk material—that is to say, perpendicular to the longitudinal axis of the splitter passing through the separating edge. In this case, the particles that pass through the plane are detected. In this variant it is possible to speak of a two-dimensional detection region.

In other words, the number stream is detected spatially in resolved manner parallel to the separating edge and transversely in relation to the longitudinal axis of the splitter. Accordingly, an assignment is performed of individual number-stream measurements to positions on an axis extending transversely in relation to the longitudinal axis of the splitter, which may also be designated as the X-axis. From this assignment the optimal position of the separating edge can be determined.

The detection region preferably does not extend over the entire width of the stream of bulk material or of the bulk-material fractions or of representative partial streams of the same.

In a further development of the aforementioned detection region, the latter can be further restricted in the plane. For example, the detection region may extend over the entire length of the separating edge and, in each instance, laterally in relation to the separating edge at a predetermined spacing. Consequently, substantially a rectangular two-dimensional detection region is made available. Depending upon the configuration, the spacing from the separating edge may be up to 50 centimeters, in particular up to 25 centimeters, particularly preferably up to 10 centimeters, and particularly preferably up to 5 centimeters. The detection region in this variant is preferentially a rectangle situated in the plane, having a length that corresponds to the length of the separating edge, and having a width that corresponds to twice said spacing.

But in the case of a single sensor the detection region may also have the form of a line extending in the horizontal plane or parallel to the separating edge.

In another variant, the detection region is defined by a cuboid of small height situated on or above the separating edge. In this variant, it is possible to speak of a three-dimensional detection region. It is accordingly a question of a flat cuboid, the longitudinal axis of which parallel to the separating edge is preferentially situated in the region of the separating edge. In its length, the flat cuboid preferentially extends over the entire length of the separating edge. In its width, the flat cuboid has been aligned perpendicular to the longitudinal axis of the splitter and extends laterally in relation to the separating edge at a predetermined spacing.

The spacing of the lateral edges of the cuboid from the separating edge may be, depending upon the configuration, up to 50 centimeters, in particular up to 25 centimeters, particularly preferably up to 10 centimeters and particularly preferably up to 5 centimeters. The height of the cuboid is preferentially below, in particular significantly below, the stated spacings.

The position of the sensor can be detected with a displacement-measuring system which determines the position of the sensor relative to a fixed reference-point. The reference-point may be a point arranged in arbitrarily fixed manner. The displacement-measuring system can then output corresponding position data which are then processed together with the number stream to yield the control signal.

In a first variant of the alignment, on the basis of the control signal the separating edge is aligned relative to the stream of bulk material directed toward the same location.

In a second variant of the alignment, the stream of bulk material is aligned relative to the stationary separating edge.

In a third variant of the alignment, on the basis of the control signal the separating edge is aligned relative to the stream of bulk material, and the stream of bulk material is aligned relative to the separating edge.

The alignment of separating edge and/or stream of bulk material can be undertaken automatically or manually. In the case of a manual setting, the control signal is forwarded to the measuring station, for example as an alarm. The plant operator thereupon checks the positioning of the separating edge in the stream of bulk material visually and corrects it manually where appropriate. In the case of an automatic alignment, the control signal serves as correcting variable for a drive unit acting on the separating edge and/or on the conveying means.

In the installation position the separating edge extends substantially in the horizontal plane. The mode of expression "substantially" includes an angular inclination of the separating edge in relation to the horizontal plane of up to 20°, in particular of up to 10°. The separating edge preferentially extends with no angular deviation or only slight angular deviation in relation to the horizontal plane. As already mentioned, the horizontal plane extends at right angles to the perpendicular plane.

The separating edge preferentially extends parallel to the transverse axis of the stream of bulk material—that is to say, transversely in relation to the direction of motion of the stream of bulk material.

The relative alignment between separating edge and stream of bulk material is preferentially undertaken in such a manner that the number stream of the particles detected by the sensor is minimal at this point. That is to say, a smaller number of particles impinges in the region of the separating edge in comparison with laterally adjacent regions alongside the separating edge. In other words, the separating edge is positioned by means of the control signal substantially where the number stream of the particles determined by means of the at least one sensor is minimal.

With regard to the aforementioned variants of the alignment, this means that the separating edge is positioned in relation to the stream of bulk material at the point at which the number stream of the particles detected by the sensor is minimal, and/or that the stream of bulk material is positioned in relation to the separating edge at the point at which the number stream of the particles detected by the sensor is minimal.

In a particularly preferred embodiment, the particles impinging in the region of the separating edge are detected exclusively with said at least one sensor. The detection region here has been oriented in the direction of the separating edge and is very narrow. The at least one sensor has accordingly been designed exclusively to detect the particle stream in the region of the separating edge. By the expression "in the region of the separating edge", it is understood that the particles impinging on the separating edge or the particles passing laterally in its immediate vicinity are detected. In this configuration, said detection region includes the separating edge itself and extends at a spacing of a few centimeters on both sides of and above the separating edge. In this variant, the at least one sensor has not been designed to detect particles passing remotely from the separating edge. In other words, the sensor has preferentially been designed to detect exclusively the particles impinging in the region of the separating edge, but not those particles of an entire bulk-material fraction or those of a partial stream thereof that is representative with respect to the separating feature. By virtue of this type of design of the sensor or of the detection region, a selective detection can occur of the particles in a selected region of the overall particle stream. This leads to a simplification of the measuring technique in comparison with the methods that detect the bulk-material fractions cumulatively, as described in WO 2012/118373 for example.

In this particularly preferred embodiment, the sensor has been fixedly connected to the splitter, and the detection region of the sensor is situated directly above the separating edge, as a result of which the particles impinging on the separating edge are measured.

In a further development of the method, the distribution function of the number stream of the particles over the corresponding positions of the at least one sensor, in particular parallel to and above the separating edge—that is to say, substantially transversely in relation to the longitudinal axis of the splitter, is determined, whereby a relative minimum of the distribution function or a relative minimum of a derivative of the distribution function is calculated and the control signal is made available on the basis of the relative minimum.

For the purpose of determining the distribution function of the number stream, the position of the at least one sensor relative to the stream of bulk material and/or to the separating edge during operation in the horizontal plane is preferentially varied barely above the separating edge in the horizontal plane. At the same time, the position of the respective sensor in relation to a fixed reference-point is detected. By this means, the distribution function can be easily determined. The sensor is preferentially displaced substantially over said detection region on both sides in relation to the separating edge. As a rule, this region encompasses a few centimeters to decimeters.

The variation or movement of the sensor can be undertaken independently of the separating edge. This means that the at least one sensor can be moved in the detection region relative to the stationary separating edge, and the separating edge can then be positioned independently of the position of the sensor.

The variation or movement of the sensor relative to the stream of bulk material can alternatively be undertaken in a manner depending on the separating edge. This means that the at least one sensor has been fixedly arranged in relation to the separating edge, and the combination of separating edge and sensor is moved jointly together. Alternatively, the stream of bulk material can also be moved relative to the sensor, for example by the trajectories of the bulk-material fractions being varied.

As an alternative to changing the position of the sensor, several sensors may also make several parallel measuring sections available. In this case, the measuring sections are preferably present in said region on both sides in relation to the separating edge. At the same time, the position of the respective sensor in relation to a fixed reference-point is determined.

In a step of separation the bulk material is preferentially divided up into the two bulk-material fractions having respectively differing flight trajectories, said step of separation occurring spatially and temporally prior to the passing of the bulk-material fractions at the level of the separating edge.

The separation is preferentially capable of being controlled with said control signal. By this means, the flight trajectories can be influenced in such a manner that one of the bulk-material fractions impinges on one side of the separating edge and the other of the bulk-material fractions impinges on the other side of the separating edge. Consequently, the stream of bulk material is aligned relative to the stationary separating edge. In addition, on the basis of the control signal the separating edge can be aligned relative to the stream of bulk material, and the stream of bulk material can be aligned relative to the separating edge.

The separation is preferentially undertaken in a bulk-material separator having a conveying means and having an exciter for making a separating force available, in which case the speed of the conveying means and/or the force acting on the bulk material, which is made available by the exciter, can be controlled by said control signal. This embodiment results in an advantageous possibility which consists in not varying the position of the separating edge but in adapting the speed of the conveyor belt on the basis of the control signal, as a result of which the stream of bulk material as a whole is displaced horizontally with respect to the separating edge. Alternatively or additionally, the field strength of the exciter can also be influenced, as a result of which the position of the stream of the second bulk-material fraction relative to the separating edge changes.

A sorting device according to the invention, in particular for implementing a method according to the description above, serves for sorting a stream of bulk material having at least a first bulk-material fraction and a second bulk-material fraction. The sorting device includes a splitter, to be positioned between the bulk-material fractions, with a separating edge directed contrary to the stream of bulk material. Furthermore, the sorting device includes at least one sensor. The bulk-material fractions only partially overlap on or slightly above the separating edge, or do not overlap. The stream of bulk material can be guided to the separating edge, said at least one sensor being designed for detecting the number stream of the particles that pass through a detection region of the at least one sensor. The detected number stream is assigned to the corresponding position of the at least one sensor, in particular relative to a fixed point in space. From the determined number stream and the corresponding position of the at least one sensor, a control signal is then generated. The separating edge and the stream of bulk material are aligned relative to one another on the basis of the control signal in such a manner that the first bulk-material fraction comes to be situated substantially on the one side and the second bulk-material fraction comes to be situated substantially on the other side in relation to the separating edge.

The generation of the control signal from number stream and position can be undertaken in a controller or in a computer, for example.

The position of the sensor can be detected with a displacement-measuring system which determines the position of the sensor on the basis of a fixed reference-point. The displacement-measuring system can then output corresponding position data which are then processed together with the number stream to yield the control signal.

The at least one sensor has preferentially been arranged in such a manner that it monitors the entire detection region.

With respect to the properties of the detection region, reference is made to the above explanatory remarks made in connection with the method.

The separating edge is preferentially positioned by means of the control signal substantially where the number stream of the particles determined by means of the at least one sensor is minimal.

The at least one sensor has preferentially been arranged in such a manner that it exclusively detects the particles impinging in the detection region. The particles outside the detection region are not detected by the at least one sensor. Since the detection region is smaller than the entire extent of the stream of bulk material, merely a part of the stream of bulk material is covered by the sensor. With regard to the number-stream distribution, this part of the stream of bulk material is not representative of the concentrate or of the residue or, more precisely, of one of the bulk-material fractions.

The at least one sensor or the detection region has preferentially been arranged in such a manner that it exclusively detects, respectively encompasses, the particles impinging in the region of the separating edge. The region of the separating edge encompasses the separating edge itself as well as a few centimeters above and on both sides of the separating edge. The detection of particles barely above the separating edge is particularly preferred.

By "above" or "over" the separating edge, a spacing is meant that is directed contrary to the approach direction of the particles flying toward the separating edge.

Particularly preferably, the sorting device has been designed in such a manner that the separating edge can be positioned relative to the stream of bulk material in the region of the point at which the number stream of the particles is minimal, and/or that the stream of bulk material can be positioned in relation to the separating edge at the point at which the number stream of the particles detected by the sensor is minimal.

In a further development of the sorting device, the distribution function of the number stream of the particles over the corresponding positions of the at least one sensor, in particular above the separating edge and laterally in relation to the separating edge, can be determined, in which case a relative minimum of the distribution function or a relative minimum of a derivative of the distribution function can be calculated and the control signal can be made available on the basis of the relative minimum.

For the purpose of determining the distribution function of the number stream, the position of the at least one sensor relative to the stream of bulk material and/or to the separating edge during operation is preferentially varied parallel to the separating edge but transversely in relation to the longitudinal axis of the splitter, which is directed contrary to the stream of bulk material. At the same time, the position of the respective sensor in relation to a fixed reference-point is detected. Alternatively, several sensors with several measuring sections parallel to the separating edge can be made available.

The at least one sensor has preferentially been arranged fixedly in relation to the separating edge or integrated into the separating edge, in which case the at least one sensor and separating edge are traversable together for the purpose of detecting the particles at various positions.

Alternatively, the at least one sensor is traversable at various positions for the purpose of detecting the particles independently of the separating edge. The detection of the number stream can consequently be undertaken independently of the actual position of the separating edge.

Particularly preferably, the at least one sensor is up to 50 centimeters, in particular up to 25 centimeters, preferably up to 10 centimeters, and particularly preferably up to 5 centimeters, away from the separating edge within a detection region.

The sensor is preferentially an optical sensor, in particular a light barrier, and/or a pressure-sensitive sensor and/or an acoustic sensor, such as a structure-borne-sound microphone. Other sensors may also be employed.

The separating edge has preferentially been designed with a positioning device with which the separating edge can be positioned relative to the streams of bulk material on the basis of the control signal.

The sorting device preferentially exhibits product outlets via which the sorted bulk-material fractions can be emitted from the sorting device, in which case further sensors for detecting the particles capable of being emitted via the product outlets have been arranged in the region of the product outlets.

In a particularly preferred embodiment, three parallel sensors have been positioned along the horizontal plane barely above the separating edge and fixedly connected to the latter, the middle sensor being situated approximately above the separating edge. In order to obtain a high yield or a high concentrate quality, the three sensors may also have been positioned a few centimeters to the side. In the optimal setting, the counting-rate on the middle sensor is lower than in the two flanking sensors. If this condition no longer obtains, the minimum has obviously drifted out of the optimal position. In this case, the separating edge, with the sensors fastened thereto, is traversed until the middle sensor again indicates a minimum in comparison with the flanking sensors (alternatively, the speed of the belt is varied minimally without the sensor and the separating edge being moved). The advantage of this arrangement is that it is independent of fluctuations in the charging quantity.

A bulk-material sorting plant comprises a sorting device (also designated as a bulk-material sorter) according to the above description and a bulk-material separator with which the bulk material can be split into the bulk-material fractions in such a manner that the bulk-material fractions only partially overlap or do not overlap. The bulk-material separator serves merely for dividing up the bulk material into the two non-overlapping or only partly overlapping regions, but not for sorting the same. Viewed in the direction of flow of the bulk material, the bulk-material separator has been arranged upstream in relation to the bulk-material sorter.

The bulk-material separator is preferentially an eddy-current separator and/or a magnetic separator and/or an electrostatic separator and/or a sensor-type sorter.

The bulk-material sorting plant preferentially further includes a conveying means with which bulk material to be separated can be supplied to the bulk-material separator.

According to another aspect, a bulk-material sorting plant—with a conveying means and with an exciter for a separating force and with a separating edge and with a sensor for detecting particles—is characterized in that the sensor detects the particles impinging on the separating edge.

The other aspect may have been configured as an alternative to, or in addition to, the features according to the above description.

A bulk-material sorting plant according to the above aspect is characterized in that the sensor detects the particles on the basis of mechanical impulses, in particular by means of a microphone.

A bulk-material sorting plant according to the above aspect is characterized in that the sensor detects the particles by optical methods, in particular by means of a light barrier.

A bulk-material sorting plant according to the above aspect is characterized in that the sensor has been fixedly connected to the separating edge or integrated into it.

A bulk-material sorting plant according to the above aspect is characterized in that, in addition to the sensor, yet further sensors for detecting particles have been provided in the region of the product outlets.

A bulk-material sorting plant according to the above aspect is characterized in that it is an eddy-current separator or a magnetic separator or an electrostatic separator or a sensor-type sorter.

A bulk-material sorting according to another aspect by means of bulk-material sorter—which includes a conveying means and an exciter for a separating force and a separating edge and a sensor for detecting particles—is characterized in that the particles impinging on the separating edge are detected with the sensor, and in that this signal is used for optimizing the separation outcome.

A bulk-material sorting according to the above aspect is characterized in that the counting-rate is determined from the signal detected by means of sensor, and in that the number-distribution function is determined from the counting-rate, and in that a relative minimum of the number-distribution function or a relative minimum of a derivative of the number-distribution function is used for optimizing the separation outcome.

A bulk-material sorting according to the above aspect is characterized in that the signal from the sensor or a quantity derived from this signal is used for positioning the separating edge.

A bulk-material sorting according to the above aspect is characterized in that the signal from the sensor or a quantity derived therefrom is used for influencing the flight trajectories of the particles, in particular by the speed of the conveying means and/or the exciter of the separating force being changed.

A bulk-material sorting according to the above aspect is characterized in that the position of the sensor during operation is varied, in order to determine a relative minimum of the number-distribution function or a relative minimum of a derivative of the number-distribution function.

A bulk-material sorting according to the above aspect is characterized in that with the separating force being suppressed the separating edge is positioned at the spacing from the active position of the exciter of the separating force at which the signal detected by the sensor just reaches a predetermined value, for example zero.

BRIEF DESCRIPTION OF THE DRAWINGS

Preferred embodiments of the invention will be described in the following on the basis of the drawings, which serve merely for elucidation and are not to be construed as restrictive. Shown in the drawings are.

DESCRIPTION OF PREFERRED EMBODIMENTS

Figure 1:
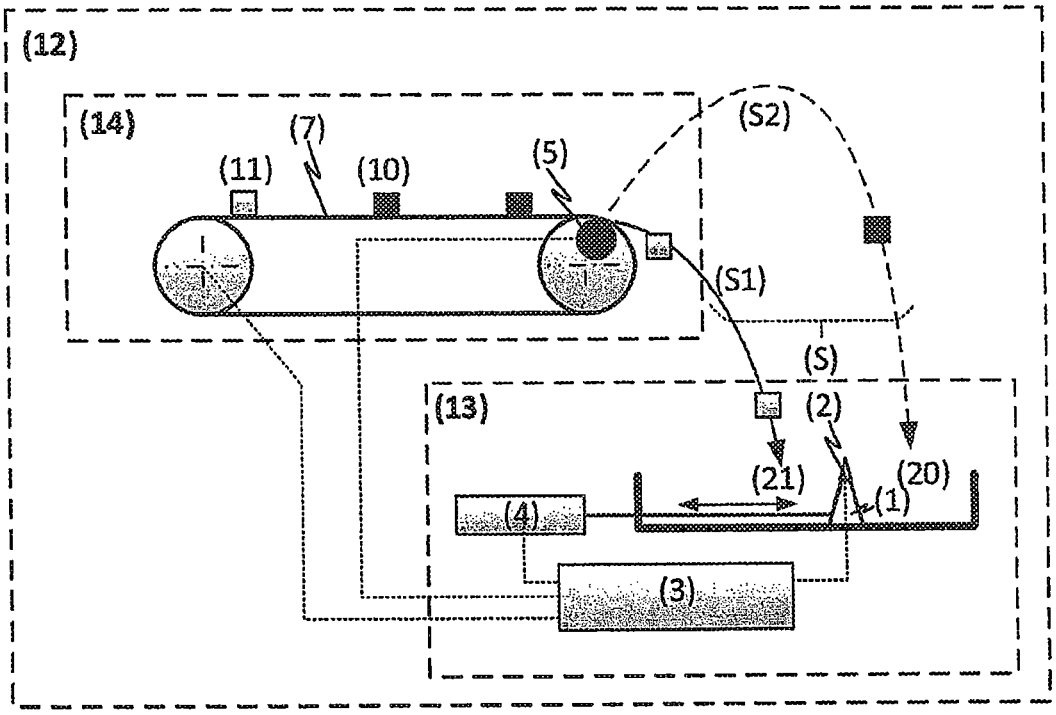
FIG. 1 an embodiment of a bulk-material sorting plant with a sorting device and with a bulk-material separator.
Figure 2:
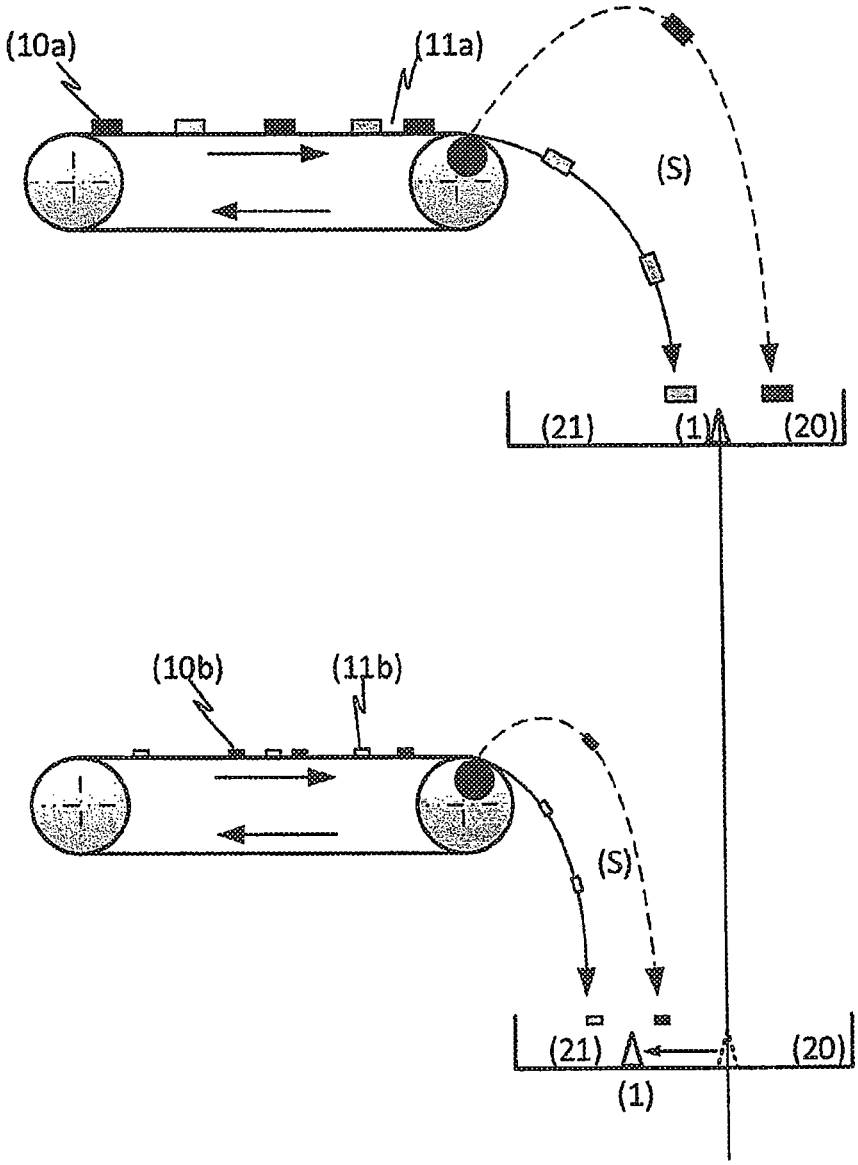
FIG. 2 a schematic representation of FIG. 1, with particles having differing flight trajectories.

Preferred embodiments of the present invention will now be elucidated on the basis of FIGS. 1 to 5.

In FIGS. 1 to 4 a bulk-material sorting plant 12 is represented schematically. The bulk-material sorting plant comprises a sorting device 13 and a bulk-material separator 14. With the bulk-material separator 14 it is possible for a bulk-material stream S to be split into a first bulk-material fraction S1 and a second bulk-material fraction S2. The two bulk-material fractions S1 and S2 then impinge on the sorting device 13 and are sorted apart there.

The first bulk-material fraction S1 comprises particles 11, and the second bulk-material fraction S2 comprises particles 10. In the sorting device 13, particles 11 are to be sorted from particles 10. For this purpose the sorting device 13 includes a splitter 1 with a separating edge which is to be positioned between the two bulk-material fractions S1, S2 so that particles 11 come to be situated on the one side and particles 10 come to be situated on the other side of the separating edge. The sorting device 13 further includes a sensor 2 with which the particles 10, 11 of the two bulk-material fractions S1, S2 appearing in the region of the separating edge can be detected. The separating edge extends substantially in the horizontal plane.

Figure 6:
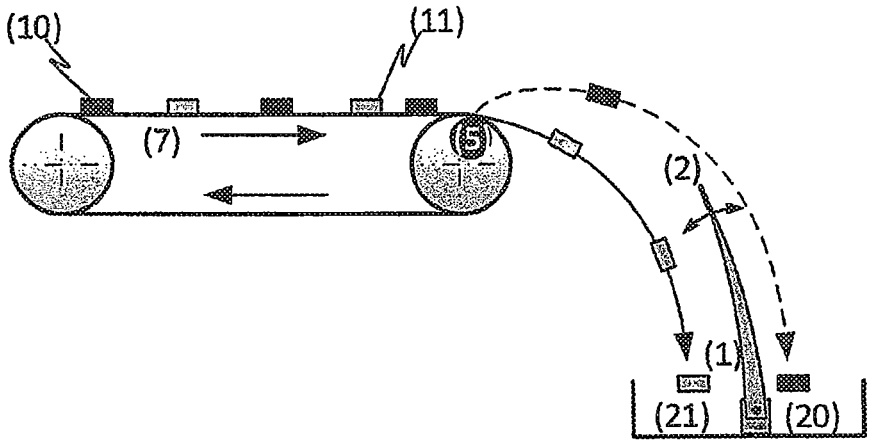
FIGS. 6-8 bulk-material sorters known from the prior art.

The bulk-material separator 14 may be an eddy-current separator according to FIG. 6. But the bulk-material separator 14 may also have been designed differently, for example as a magnetic separator (FIG. 7) or as an electrostatic separator (FIG. 8). In principle, bulk-material separators of such a type, with which a bulk-material stream S can be divided up into two or more bulk-material fractions, are known from the prior art. The bulk-material separator 14 comprises a material feed 7 and an exciter 5 for the separating force with which the stream of bulk material can be separated.

According to the method according to the invention for sorting a bulk-material stream S having at least the first bulk-material fraction S1 and the second bulk-material fraction S2, the bulk-material stream S is directed onto the separating edge to be positioned between the bulk-material fractions S1, S2 and onto the at least one sensor 2. The bulk-material fractions S1, S2 do not overlap or overlap only partially in the region of the separating edge—that is to say, on or slightly above the separating edge. "Slightly above the separating edge" means, for example, within a range of at most 50 centimeters, in particular at most 10 centimeters, vertically above the cutting edge. The at least one sensor 2 detects the number stream of the particles that pass through a detection region of the at least one sensor. On the basis of a linkage of the sensor position with the number stream detected at this point, a control signal is made available. The separating edge and the bulk-material stream S are aligned relative to one another on the basis of the control signal, specifically in such a manner that the first bulk-material fraction S1 comes to be situated substantially on the one side and the second bulk-material fraction S2 comes to be situated substantially on the other side to that of the splitter 1. By this means, the bulk-material fractions are easily split apart.

By a "number stream", the number of particles impinging over a predetermined unit of time is understood. For example, the unit of time may be a minute or a second.

With respect to the relative positioning arrangements, in particular the following configurations are conceivable:

- The flight trajectories of the bulk-material fractions are influenced by the bulk-material separator in such a manner that the bulk-material fractions impinge on the corresponding side of the separating edge. For example, with the control signal the speed of the material feed 7 or, to be more exact, of the conveying means 7 is influenced and/or the power of the exciter 5 is influenced.
- The position of the separating edge is displaced relative to the stream of bulk material on the basis of the control signal.
- The position of the separating edge and the flight trajectories are influenced on the basis of the control signal.

The relative alignment between separating edge and bulk-material stream S is preferentially undertaken in such a manner that the number stream of the particles in the region of the separating edge is minimal. The separating edge is accordingly positioned at the minimum, whereas the sensor may be somewhere else entirely. The sensor is imperatively located at the minimum only when it has been fixedly mounted on the separating edge.

According to a preferred embodiment of the method according to the invention, the particles impinging in the region of the separating edge are detected by means of the sensor 2. The number of particles impacting per unit of time is designated as the counting-rate or number stream (for example, in number/min=#/min). The current counting-rate determined in this way is compared with the counting-rate at another position in the particle stream S and is used for positioning the separating edge and/or for influencing the flight trajectories of the particles. As a rule, the positioning of the separating edges is performed in such a way that the current counting-rate is at a relative minimum in comparison with the counting-rates after a slight displacement of the separating edge to the right or to the left.

Figure 3:
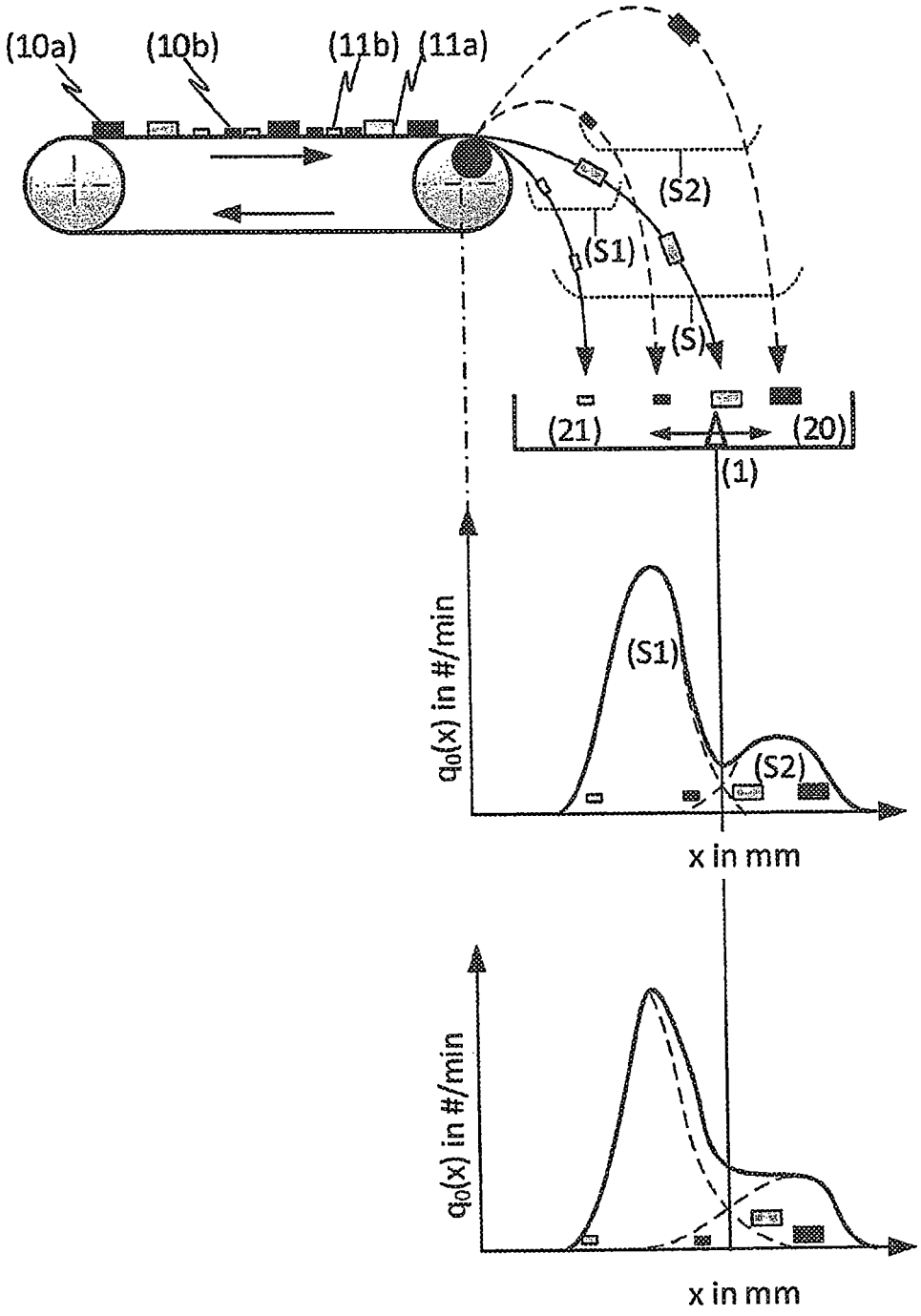
FIG. 3 a schematic representation of FIGS. 1 and 2 with the distribution of the particles.

As sketched in FIG. 3, the plotting of the counting-rate against the spacing x yields a bimodal number-distribution function $q_0(x)$. The left "bump" therein represents the non-conductive material (11), and the right "bump" the conductive material (10). An ideal positioning of the separating edge lies within the region of the minimum of the number-distribution function $q_0(x)$. Depending upon whether a good concentrate quality or a high yield of conductive particles is being striven for, the edge of the separating edge is positioned somewhat to the right or to the left of this relative minimum. On the basis of this insight, the optimal positioning of the separating edge for a separation of conductive and non-conductive material can accordingly be undertaken solely by identification of the minimum of the counting-rate—an additional determination of the metal contents is not necessary. In contrast to WO 2012/118373 A1, the number of particles in one product or in both products of the separation is accordingly not determined directly or indirectly by measurement of representative partial streams, but rather the locally—preferentially horizontally—resolved particle-stream distribution is determined. In contrast to WO 2012/118373 A1, the detection region preferentially does not extend over the entire width of the bulk-material streams S1 and S2 but extends only to the regions of the streams of bulk material that are adjacent (the right flank of S1 and the left flank of S1)—that is to say, to the region between the two "bumps", and in particular to the regions in which the bulk-material streams S1 and S2 overlap.

In a preferred embodiment of the invention, in contrast to WO 2012/118373 A1 the number stream is measured of particles that cannot be incontestably assigned to one of the products because they are impacting precisely on the separating edge.

In a preferred embodiment, as shown in FIG. 1, the sensor 2 has been connected via a data-processing unit 3 to an actuator 4 which performs the positioning of the separating edge, and/or to a means for changing the flight trajectories of the particles, in particular to the drive unit of the conveying means 7 and/or to the exciter 5 of the separating force. The data-processing unit 3 may also be designated as a controller or control unit.

The sensor 2 may have been designed in diverse ways. For example, the sensor may be an optical sensor, such as a light barrier for example (FIG. 5*c*). But the sensor may also take the form of a pressure-sensitive sensor or acoustic sensor. Depending upon the arrangement, the sensor 2 may have been fixedly connected to the separating edge or it may have been designed to be displaceable relative to the separating edge.

Figure 5A:
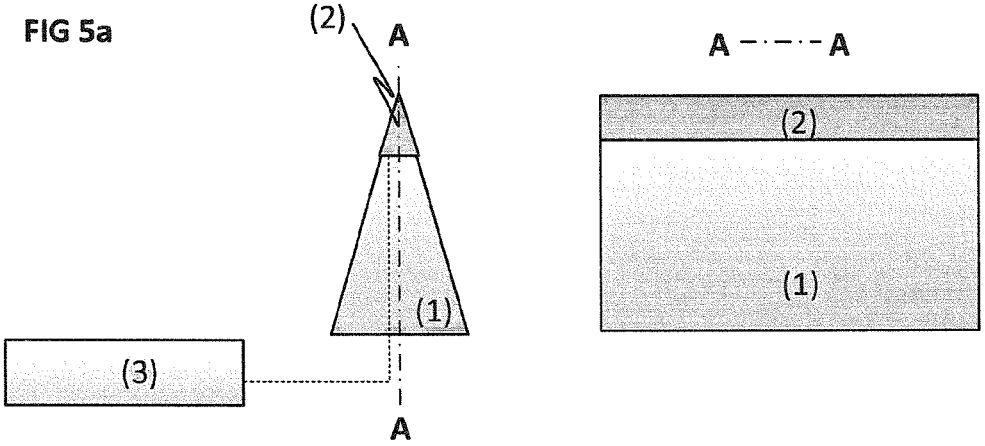
FIGS. 5*a,b,c* schematic representations of sensors in the region of the separating edge, which can be employed in a bulk-material sorting plant according to one of the preceding figures.
Figure 5C:
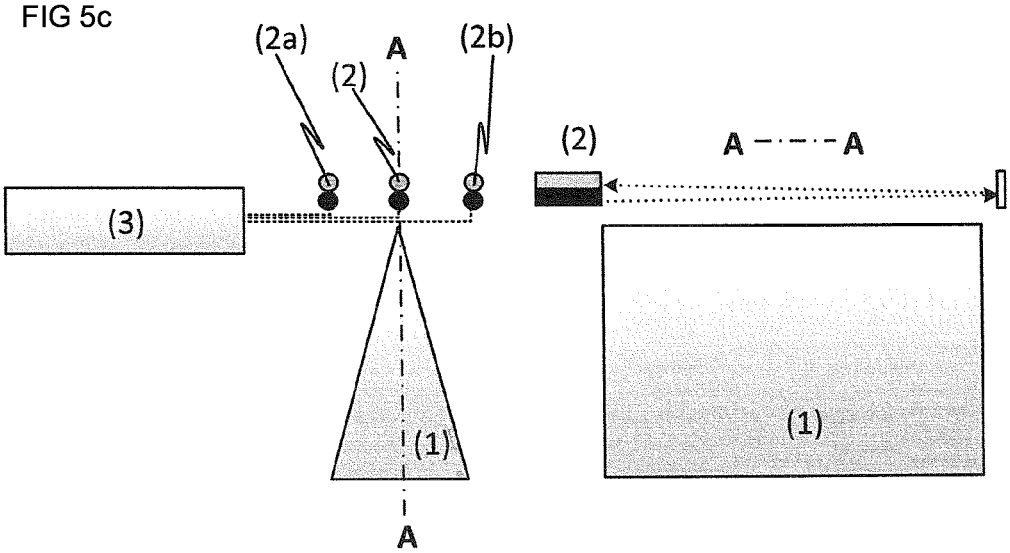

As in FIGS. 5*a, b*, and *c* several sensors 2, 2*a*, 2*b* may also have been provided. In FIGS. 5*a* and 5*c*, sensor 2 is located in the region of the separating edge, and sensors 2*a*, 2*b* have been arranged to be spaced to the left and right in relation to the separating edge. In this case, all three sensors are in communication with the data-processing unit 3. On the basis of the sensor data, said control signal can then be made available on the basis of the measured particle stream and the corresponding sensor position.

In all embodiments, the at least one sensor 2 has preferentially been arranged in such a manner that it detects a predetermined region (the "detection region" defined above) of the particles appearing but not those particles which lie outside the predetermined region. In a preferred embodiment, the at least one sensor has been arranged in such a manner that it exclusively detects the particles appearing in the region of the separating edge.

A preferred embodiment of the device according to the invention consists in utilizing as sensor 2 a structure-borne-sound microphone which has been integrated into the separating edge and detects the impact noises of the particles on the separating edge (FIG. 5*a*). The structure-borne-sound microphone is an example of an acoustic sensor. In order to suppress disturbing impact noises when particles strike the flanks of the splitter 1, said flanks (in particular, the flank on the concentrate side) can be provided with a rubber coating. Alternatively, sensors enter into consideration that detect particles immediately prior to impingement on the separating edge, for example by means of a light barrier or by disturbance of an electric field. Instead of determining the counting-rate directly, the latter can also be derived from other measurements, for example by measurement of the impulse transmitted to the sensor. As a rule, in this case sensor 2 has been rigidly connected to the separating edge.

The position of the separating edge is preferentially set, for example by means of a worm gear, via the counting-rate. A manual setting of the separating edge, for example on the basis of an acoustic signal, would also be conceivable. But, in principle, in the case of a fixed position of the separating edge there is also the possibility to vary, for example, the speed of the conveying means 7 or the exciter for the separating force 5, in order to influence the flight trajectories of the particles relative to the separating edge.

A preferred configuration of the method according to the invention consists in that the sensor samples the counting-rate periodically (for example, once per minute) in the neighborhood of the current position of the separating edge (for example, +/−30 cm), and the separating edge is subsequently positioned at the relative minimum of the number-distribution function measured in this way. The particular advantages of this method are evident from FIG. 2. As represented at the top in FIG. 2, coarse material was firstly processed. Subsequently, however, mainly fine-grained material arrives at the eddy-current separator. On account of the steeper flight trajectories of the fine-grained particles, all the material is now discharged in the residue 21—in the original position of the separating edge no separation takes place any longer. However, by virtue of the periodic sampling of the neighborhood of the separating edge the sensor finds the new relative minimum in the number-distribution function (FIG. 2) below, and the separating edge is repositioned there by the data processing.

In addition to sensor 2, which detects the counting-rate on the separating edge, further sensors 2*a* and 2*b* may be installed, as sketched at FIG. 5*c*. In this case, a displacement of the minimum of $q_0(x)$ in operation could also be measured without periodic sampling, by displacement of the separating edge. In normal operation the central sensor 2 measures a lower counting-rate than the two flanking sensors 2*a* and 2*b*. If, however, the counting-rate minimum shifts to the right, for example, the counting-rate of sensor 2*b* becomes lower than that of 2 and of 2*a*. In this case, the data processing would displace the sensors further to the right via an actuator until such time as sensor 2 again outputs lower counting-rates than sensors 2*a* and 2*b*—that is to say, the new minimum of the number-distribution function has been found. The separating edge is now moved into this position.

If the particle clouds of the conductive and non-conductive material overlap very considerably, for example as a consequence of a broad grain-size distribution of the material, it may happen that the optimal region for the positioning of the separating edge is marked not by a relative minimum but only by a point of inflection of the number-distribution function (FIG. 3, bottom). In this case, the optimal position of the separating edge would result as the minimum of the first derivative of the number-distribution function $q_0(x)$ with respect to the horizontal spacing x.

Figure 4:
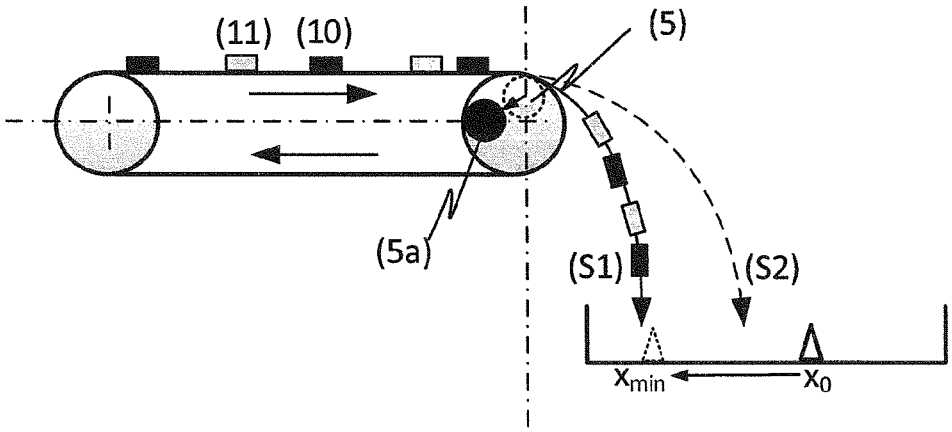
FIG. 4 a schematic representation of FIGS. 1 and 2 with the distribution of the particles.

A particular advantage of the device according to the invention is the possibility of the very simple optimization of the position of the separating edge by temporary suppression of the separating force (FIG. 4). The exciter 5 of the separating force is briefly switched off in operation or transferred from its "active position" 5 into a "neutral position" 5*a*, so that no separating force is acting on the material 10 and consequently no deflection takes place. The material 10, just like the material 11, accordingly follows the trajectories for the horizontal projection—that is to say, those of S1. Subsequently the separating edge with the integrated sensor 2 is moved to the left, starting from an initial position $x_0$, and positioned at $x_{min}$, where the counting-rate just exceeds zero. Subsequently the exciter 5 of the separating force is switched on again or moved back into the active position. In this way, the separating edge was positioned automatically in such a way that only particles 10 overcome the separating edge and are transferred into the concentrate. An analogous way of proceeding may, for example, also be locked into the start-up procedure of the bulk-material sorting plant in such a way that the separating edge has already been positioned before the exciter 5 of the separating force is switched on.

Figure 7:
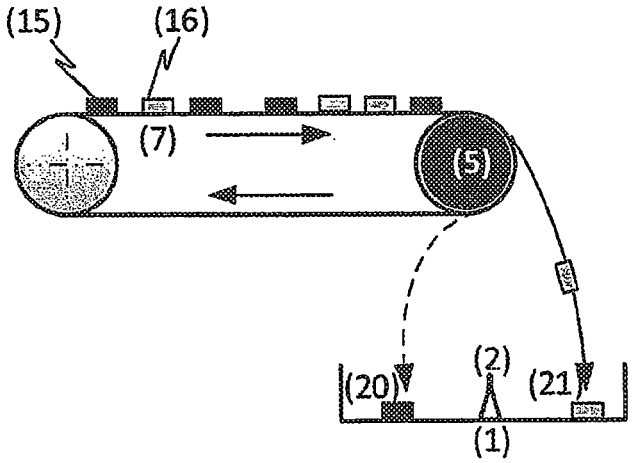
Figure 8:
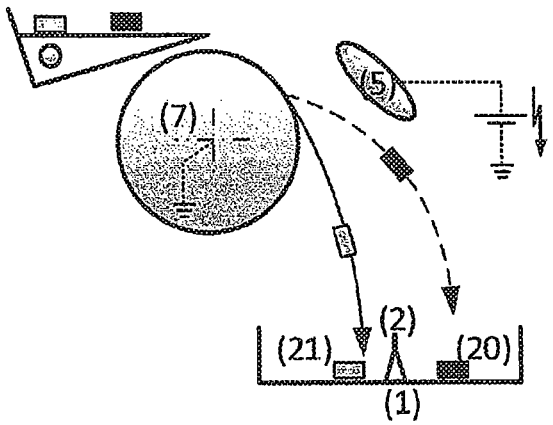

The exemplary configurations above for an eddy-current separator can, with due alteration of details, be carried over to other sorting appliances with separating edges, as sketched in FIG. 7 for a magnetic-deflection separator or in FIG. 8 for an electrostatic-influence separator.

Figure 5B:
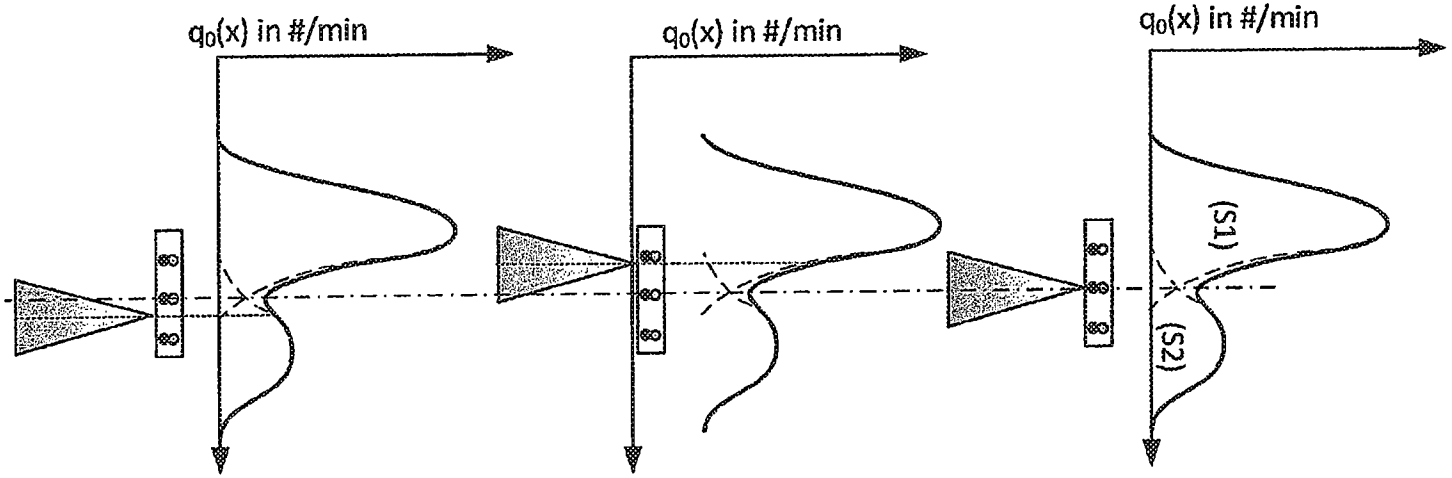

With reference to FIG. 5*b*, the following will also be elucidated: three parallel sensors (preferentially light barriers) have been positioned along the horizontal plane barely above the separating edge and fixedly connected to the latter, the middle sensor being situated approximately above the separating edge (FIG. 5*b*, top). In order to obtain a high yield or a high concentrate quality, the three sensors may also have been positioned a few centimeters to the side of the separating edge, as shown in FIG. 5*b* (middle and bottom). In the optimal setting, the counting-rate on the middle sensor is lower than in the two flanking sensors. If this condition no longer obtains, the minimum has obviously drifted. In this case, the separating edge, with the sensors fastened thereto, is traversed until the middle sensor again indicates a minimum in relation to the flanking sensors (alternatively, the speed of the belt is varied minimally without the sensor and the separating edge being moved). The advantage of this arrangement is that it is independent of fluctuations in the charging quantity.

Alternatively, the sensors have not been fixedly connected to the separating edge, so that the sensors can be traversed independently of the separating edge.

LIST OF REFERENCE SYMBOLS

1 splitter with separating edge
2 sensor
3 data-processing unit
4 actuator
5 exciter in active position
5*a* exciter in neutral position
7 conveying means
10 electrically conductive material or particle
11 electrically non-conductive material or particle
12 bulk-material sorting plant
13 bulk-material separator
14 bulk-material sorter
20 product outlet, concentrate
21 product outlet, residue
S stream of bulk material
S1 first bulk-material fraction
S2 second bulk-material fraction

The invention claimed is:

1. A method for sorting a bulk-material stream having at least a first bulk-material fraction and a second bulk-material fraction, directing the bulk-material stream toward a splitter to be positioned between the bulk-material fractions and having a separating edge, wherein the bulk-material fractions only partially overlap or do not overlap on or slightly above the separating edge, detecting, with at least one sensor, the number stream of the particles that pass through a detection region of the at least one sensor, the detected number stream being assigned to a corresponding position of the at least one sensor, wherein said detection region includes only the separating edge and an area that extends at a spacing of up to 5 cm on both sides of the separating edge and up to 10 cm vertically above the separating edge, determining a distribution function of the number stream of the particles by varying the position of the at least one sensor relative to at least one of the bulk-material stream and to the separating edge in the detection region during operation, or taking several parallel measurement sections using several sensors;

generating a control signal from the distribution function from the measured number stream and from the corresponding position of the at least one sensor, aligning the separating edge and the bulk-material stream relative to one another on the basis of the control signal in such a manner that the first bulk-material fraction comes to be situated substantially on one side and the second bulk-material fraction comes to be situated substantially on another side of the splitter.

2. The method as claimed in claim 1, wherein at least one of the detection region of the at least one sensor extends substantially parallel to the separating edge and the detection region is situated above the separating edge.

3. The method as claimed in claim 1, wherein the separating edge is directed contrary to the bulk-material stream.

4. The method as claimed in claim 1, wherein the detection region is defined by a plane that extends substantially parallel to the separating edge or at least one of the detection region is defined by a cuboid situation on or above the separating edge, the longitudinal axis of which extends parallel to the separating edge, and wherein the detection region does not extend over the entire width of the bulk-material streams.

5. The method as claimed in claim 4, wherein at least one of the plane extends on or above the separating edge and said longitudinal axis of the cuboid coincides with the separating edge or the underside of the cuboid rests on the separating edge.

6. The method as claimed in claim 1, wherein the separating edge is positioned by means of the control signal substantially where the number stream of the particles determined by means of the at least one sensor is minimal.

7. The method as claimed in claim 1, wherein the at least one sensor exclusively detects the particles impinging in the region of the separating edge but not the particles impinging outside said region.

8. The method as claimed in claim 1, wherein the distribution function of the number stream of the particles above the corresponding positions of the at least one sensor is determined, and wherein a relative minimum of the distribution function or a relative minimum of a derivative of the distribution function is determined, and wherein the separating edge is positioned relative to the stream of bulk material in the vicinity of this minimum.

9. The method as claimed in claim 8, wherein the distribution function of the number stream of the particles at least one of above the separating edge and laterally in relation to the separating edge is determined.

10. The method as claimed in claim 1, wherein in a step of separation the bulk material is divided up into the two bulk-material fractions having respectively differing flight trajectories, said step of separation occurring spatially and temporally prior to the impinging of the bulk-material fractions on the separating edge.

11. The method as claimed in claim 10, wherein the separation is controlled with said control signal.

12. The method as claimed in claim 10, wherein the separation is undertaken in a bulk-material separator having a conveying means and an exciter for making a separating force available, wherein at least one of the speed of the conveying means and the force made available by the exciter and acting on the bulk material is/are controlled by said control signal.

13. The method as claimed in claim 12, wherein in a step of setting the separating edge the separating edge is positioned, with separating force suppressed, at the spacing from the active position of the exciter of the separating force at which the signal detected by the sensor reaches a predetermined value.

14. A sorting device for sorting a bulk-material stream having at least a first bulk-material fraction and a second bulk-material fraction, the sorting device comprising:

a splitter, to be positioned between the bulk-material fractions, having a separating edge directed contrary to the stream of bulk material, wherein the bulk-material fractions only partially overlap or do not overlap on or slightly above the separating edge, the stream of bulk material being guided to the separating edge, wherein said detection region includes only the separating edge and an area that extends at a spacing of up to 5 cm on both sides of the separating edge and up to 10 cm vertically above the separating edge, at least one sensor to detect the number stream of the particles that pass through the detection region of the at least one sensor, the detected number stream is assigned to a corresponding position of the at least one sensor, a data processing unit for determining a distribution function to generate a control signal from the determined number stream and the corresponding position of the at least one sensor, the distribution function being determined by varying the position of the at least one sensor relative to at least one of the bulk-material stream and the separating edge parallel to the separating edge during operation, or taking several measuring sections by several sensors parallel to the separating edge, and wherein the separating edge and the bulk-material stream are aligned relative to one another on the basis of the control signal in such a manner that the first bulk-material fraction comes to be situated substantially on the one side and the second bulk-material fraction comes to be situated substantially on the other side of the splitter.

15. The sorting device as claimed in claim 14, wherein the at least one sensor has been arranged in such a manner that it exclusively detects the particles impinging in the detection region.

16. The sorting device as claimed in claim 15, wherein at least one of the separating edge can be positioned in relation to the bulk-material stream at the point at which the number stream of the particles detected by the sensor is minimal and the bulk-material stream can be positioned in relation to the separating edge at the point at which the number stream of the particles detected by the sensor is minimal.

17. The sorting device as claimed in claim 14, wherein the distribution function of the number stream of the particles over the separating edge and laterally in relation to the separating edge can be determined, and wherein a relative minimum of the distribution function or a relative minimum of a derivative of the distribution function can be calculated, in which case said control signal can be made available on the basis of the relative minimum.

18. The sorting device as claimed in claim 14, wherein the at least one sensor is arranged fixedly in relation to the separating edge or integrated into the separating edge, said at least one sensor and said separating edge being traversable together for the purpose of detecting the particles at various positions; or wherein the at least one sensor is traversable to various positions for the purpose of detecting the particles independently of the separating edge.

19. The sorting device as claimed in claim 14, wherein the at least one sensor is at least one of an optical sensor and a pressure-sensitive sensor and an acoustic sensor.

20. The sorting device as claimed in claim 14, wherein the separating edge has been designed with a positioning device with which the separating edge can be positioned relative to the bulk-material stream on the basis of the control signal.

21. The sorting device as claimed in claim 20, the sorting device being for implementing a method for sorting a bulk-material stream having at least a first bulk-material fraction and a second bulk-material fraction, the method including:

directing the bulk-material stream toward to be positioned between the bulk-material fractions and comprising the separating edge, wherein the bulk-material fractions only partially overlap or do not overlap on or slightly above the separating edge, detecting, using the at least one sensor, the number stream of the particles that pass through a detection region of the at least one sensor, the detected number stream being assigned to the corresponding position of the at least one sensor, generating the control signal from the measured number stream and from the corresponding position of the at least one sensor, and aligning the separating edge and the bulk-material stream relative to one another on the basis of the control signal in such a manner that the first bulk-material fraction comes to be situated substantially on the one side and the second bulk-material fraction comes to be situated substantially on the other side of the splitter.

22. The sorting device as claimed in claim 21, wherein the optical sensor is a light barrier.

23. A bulk-material sorting plant comprising a sorting device as claimed in claim 20 and a bulk-material separator with which the bulk material can be split into the bulk-material fractions in such a manner that the bulk-material fractions only partially overlap or do not overlap.

24. The bulk-material sorting plant as claimed in claim 23, wherein the bulk-material separator is an eddy-current separator or a magnetic separator or an electrostatic separator or a sensor-type sorter.

25. The bulk-material sorting plant as claimed in claim 23, wherein the bulk-material sorter further includes a conveying means with which bulk material to be separated can be fed to the bulk-material separator.

26. The sorting device as claimed in claim 14, wherein the sorting device comprises product outlets via which the sorted bulk-material fractions can be emitted from the sorting device, further sensors for detecting the particles capable of being emitted via the product outlets being arranged in the region of the product outlets.

27. The sorting device as claimed in claim 14, wherein the at least one sensor can be moved relative to the separating edge independently of the separating edge, or wherein the at least one sensor can be moved jointly with the separating edge.

* * * * *